United States Patent [19]

Ichikawa

[11] 4,175,377

[45] Nov. 27, 1979

[54] TIMEPIECE WITH DISPLAY DEVICE FOR WARNING BATTERY LIFE

[75] Inventor: Singo Ichikawa, Sayama, Japan

[73] Assignee: Citizen Watch Co. Ltd., Tokyo, Japan

[21] Appl. No.: 848,666

[22] Filed: Nov. 4, 1977

[30] Foreign Application Priority Data

Nov. 5, 1976 [JP] Japan ..... 51-132988

[51] Int. Cl.[2] ..... G04C 17/00

[52] U.S. Cl. ..... 58/23 BA; 58/85.5; 58/58; 58/50 R; 58/152 H

[58] Field of Search ..... 58/4 A, 23 R, 23 A, 58/23 BA, 50 R, 58, 85.5, 152 H

[56] References Cited

U.S. PATENT DOCUMENTS

| | | | |
|---|---|---|---|
| 3,898,790 | 8/1975 | Takamane | 58/152 H |
| 3,991,553 | 11/1976 | Bergey | 58/152 H |
| 3,998,043 | 12/1976 | Tamaru | 58/23 R |
| 4,044,544 | 8/1977 | Yagi | 58/85.5 |

*Primary Examiner*—Gene Z. Rubinson
*Assistant Examiner*—William L. Feeney
*Attorney, Agent, or Firm*—Sherman & Shalloway

[57] ABSTRACT

A timepiece provided with a display device for warning a battery life is disclosed. The timepiece comprises a correction signal control circuit which is controlled by two exteriorly operable switches and which control a battery voltage detection circuit whose sampling operation together with the warning display are interlocked with the operation of one of the exteriorly operable switches which functions as a digit selection switch, correction switch and display change-over switch. A warning display for a short time can be noticed by a bearer by operating the exteriorly operable switch without fail.

8 Claims, 6 Drawing Figures

TIMEPIECE WITH DISPLAY DEVICE FOR WARNING BATTERY LIFE

BACKGROUND OF THE INVENTION

1. Field of the Invention

This invention relates to a timepiece provided with a display device for warning a battery life and more particularly to an improved timepiece which can detect a voltage of a battery used as an electric supply source of the timepiece and display a battery life with the aid of a display device of the timepiece.

2. Description of the Prior Art

An electronic timepiece which makes use of a battery as an energy source loses its operating ability as soon as the battery comes to an end of its life. As a result, it is necessary to provide means for informing beforehand a time at which the battery comes to the end of its life.

In order to warn and display a battery life by detecting a given voltage drop condition of a battery, heretofore, it has been proposed to provide a timepiece comprising a display device for warning a battery life and a battery voltage detection circuit which makes use of a threshold level of a field effect transistor. As well known in the art, a battery voltage is so related to a battery capacity that when the battery capacity becomes small the battery voltage becomes also low. As a result, it is possible to detect the amount of lowered battery capacity by detecting the amount of decrease of the battery voltage. The amount of lowered battery voltage can be detected by the battery voltage detection circuit.

In FIG. 1 is shown a basic circuit representing a battery voltage detection circuit. In FIG. 1, reference numeral 1 designates an enhancement type P-MOS-FET, 2 to 5 each shows a complementary type inverter formed of a MOS-FET, 6 and 7 each illustrates a transmission gate and 8 designates a load resistor composed of a variable resistor. An inverter 9 is connected to the input of the voltage detection circuit and another inverter 10 to the output thereof. Both inverters 9, 10 serve to operate the voltage detection circuit in positive logic.

In the circuit shown in FIG. 1, the battery voltage detection circuit is composed of the P-MOS-FET 1, MOS-FET 2, 3 and variable resistor 8. A memory circuit is composed of the MOS-FETs 4, 5 and transmission gates 6, 7. The battery voltage detection circuit functions to effect sampling detection only when the gate voltage of the P.MOS-FET 1 becomes "H", that is, when a sampling detection instruction signal a becomes "H". During this time, the memory circuit functions to write therein an output delivered from the battery voltage detection circuit. When the sampling detection instruction signal a becomes "L", the battery voltage detection circuit does not effect the sampling detection and the memory circuit becomes its hold condition. The sampling detection is effected for the purpose of reducing an electric current to be consumed.

In the voltage detection circuit shown in FIG. 1, however, the FET transistor 1 and the detection level adjustable resistor 8 constitute a voltage divider circuit, so that an electric current to be consumed by the detecting operation is increased to a value which could not be disregarded. In order to obviate such disadvantage, it has heretofore been proposed to use a system of detecting intermittently a battery voltage with the aid of a sampling pulse having a period on the order of 1 second to 1 minute. If the period of such sampling pulse becomes too short, the consumed electric current is increased. On the contrary, if the period of such sampling pulse becomes too long, the consumed electric current is decreased, but when an erroneous operation occurs, such erroneous operation persists until the next sampling is effected. As a result, it is obliged to use the above mentioned short sampling period at the sacrifice of the loss of the consumed electric current.

SUMMARY OF THE INVENTION

A main object of the invention is to provide a timepiece provided with a display device for warning a battery life, which can eliminate the above mentioned drawback which has been encountered with the prior art techniques.

Another object of the invention is to provide a timepiece provided with a display device for warning a battery life, which can reduce an electric current to be consumed by detecting a battery voltage.

A further object of the invention is to provide a timepiece provided with a display device for warning a battery life, which makes use of a battery voltage detection circuit which is less influenced by an erroneous operation.

In order to attain the above mentioned objects, a feature of the invention is the provision in a conventional digital electronic timepiece comprising a crystal oscillator, an oscillation circuit, a frequency divider circuit, a time counter circuit, a decoder, a driver circuit and an electronic optical display device, of the improvement in a timepiece provided with a display device for warning a battery life, comprising a display change-over-control means, a battery voltage detection circuit provided with a sampling terminal and an output terminal and detecting a battery voltage, a correction signal control means which is controlled by two exteriorly operable switches, the first of which controls said display change-over control means and said battery voltage detection circuit when the second of which is in the normal display mode; and the first of which digitally advances the display when the second of which is in the correction mode.

DESCRIPTION OF THE PREFERRED EMBODIMENTS

The embodiments of the invention will now be described with reference to the accompanying drawings.

Figure 2:
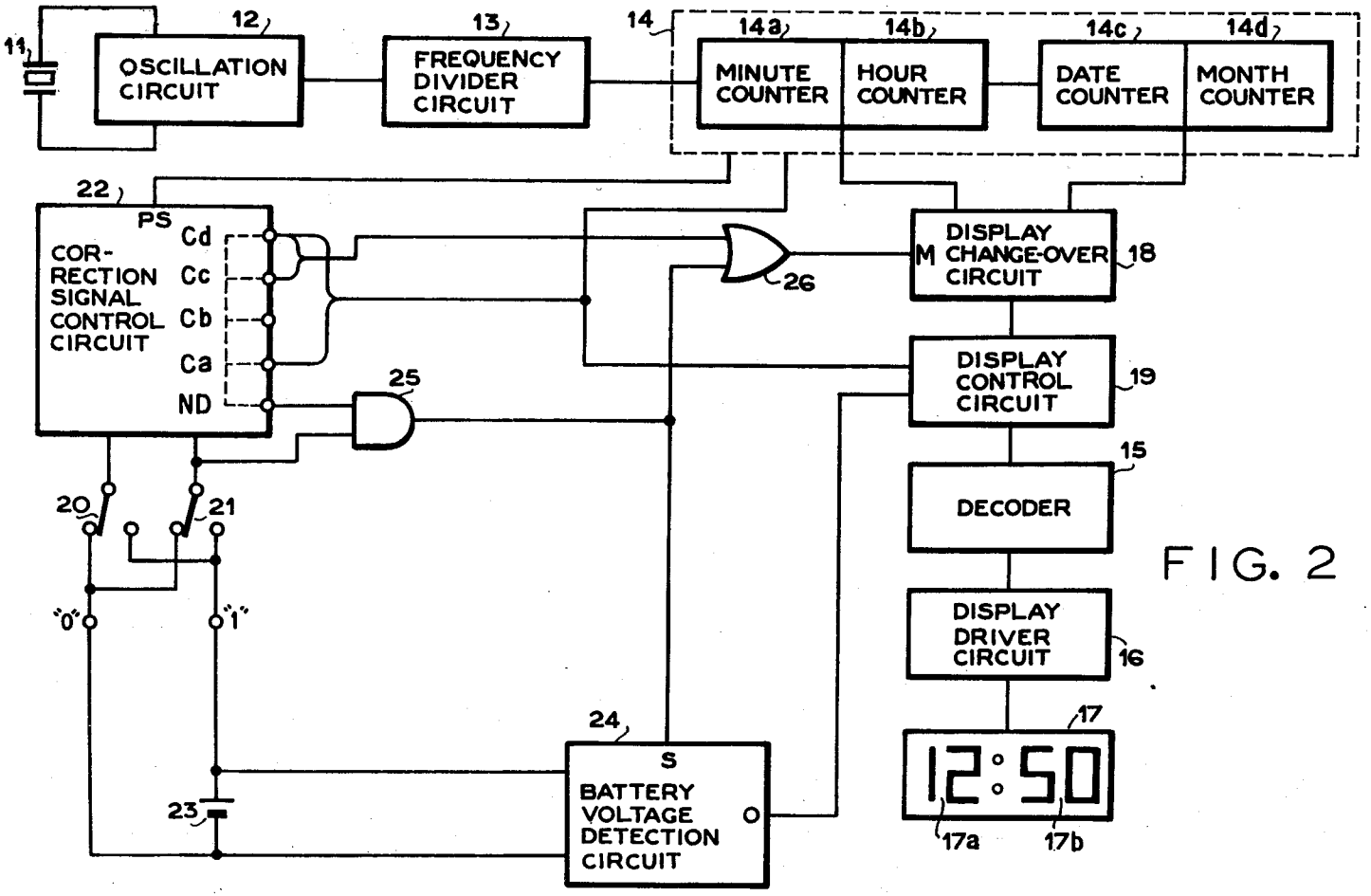
FIG. 2 is a block diagram of one embodiment of a timepiece provided with a display device for warning a battery life according to the invention.

In FIG. 2 is shown a timepiece provided with a display device for warning a battery life according to the invention. Referring to FIG. 2, reference numeral 11 designates a crystal oscillator whose output is supplied as a time reference signal through an oscillation circuit 12 to a frequency divider circuit 13. In the frequency divider circuit 13, the frequency of the time reference signal is divided into time counting unit signals which are delivered to a time counter circuit 14. The time counter circuit 14 is composed of a minute counter 14*a* and hour counter 14*b* and a date counter 14*c* and a month counter 14*d*. Reference numeral 18 designates a display change-over circuit for receiving an hour-minute output and a month-date output from the time counter circuit 14 and delivering an output to a display control circuit 19. The display control circuit 19 delivers its output to a decoder 15 whose output is delivered through a display driver circuit 16 to an electronic optical display device 17 such as a liquid crystal display device which is then driven to effect a given display. In FIG. 2, the display device 17 displays 12 hours: 50 minutes and is composed of a first display portion 17*a* and a second display portion 17*b*. The display change-over circuit 18 functions to change over the time information, i.e., hour, minute to the calender information, i.e., month, date and vice versa and functions to display respective time and calendar informations on corresponding display portions of the electronic optical display device 17. If the control terminal M of the display change-over circuit 18 is set to a logical value "O", the first display portion 17*a* and second display portion 17*b* of the electronic optical display device 17 display the time information delivered from the hour counter 14*b* and minute counter 14*a*. If the control terminal M of the display change-over circuit 18 is set to a logical value "1", the first display portion 17*a* and second display portion 17*b* of the electronic optical display device 17 display the calendar information delivered from the month counter 14*d* and date counter 14*c*.

Reference numeral 20 designates a digit selection switch. The digit selected by the digit selection switch 20 is corrected by a correction switch 21. Correction switch 21 and selection switch 20 are, respectively, the first and second switches of the two exteriorly operable switches which control the correction signal control circuit 22.

Figure 6:
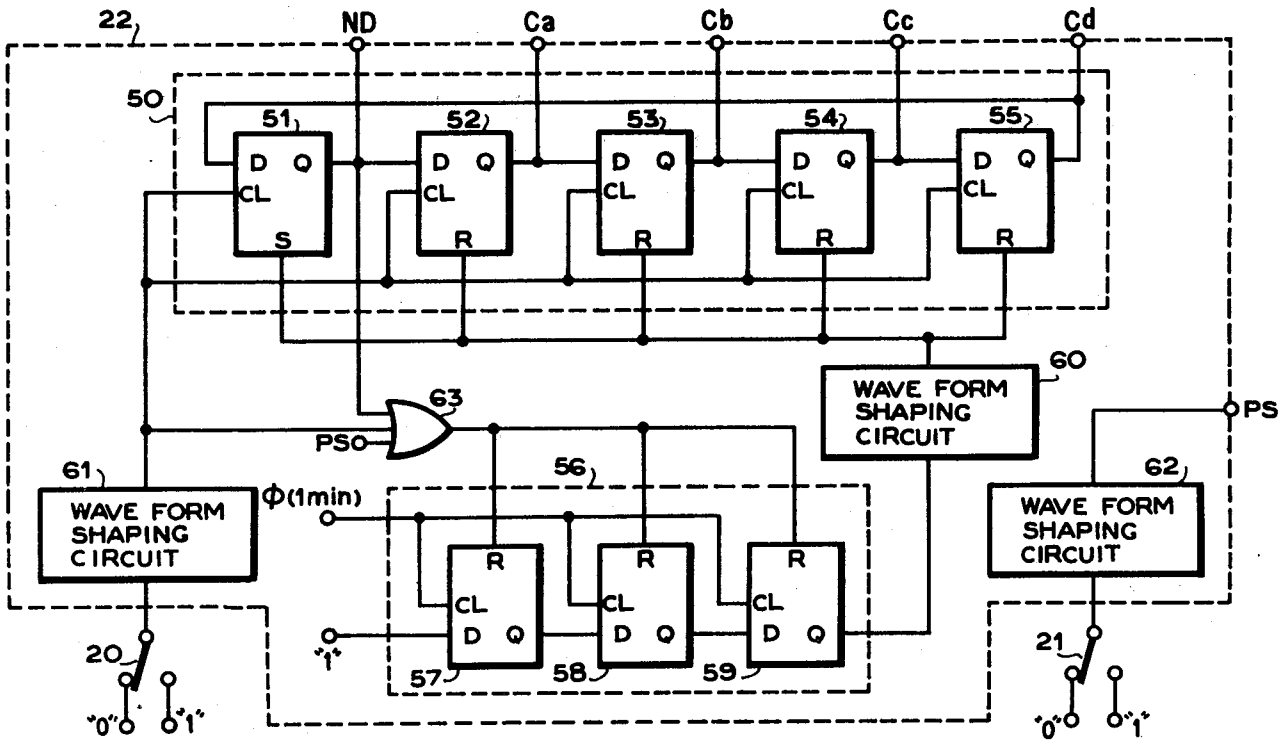
FIG. 6 is a block diagram of a correction signal central circuit shown in FIG. 2.

In FIG. 6 is shown a correction signal control circuit 22 which receives operating signals from the digit selection switch 20 and the correction switch 21 and functions to supply signals to its normal display terminal ND, time correction terminals Ca to Cd and to a correction signal terminal PS, respectively.

Figure 1:
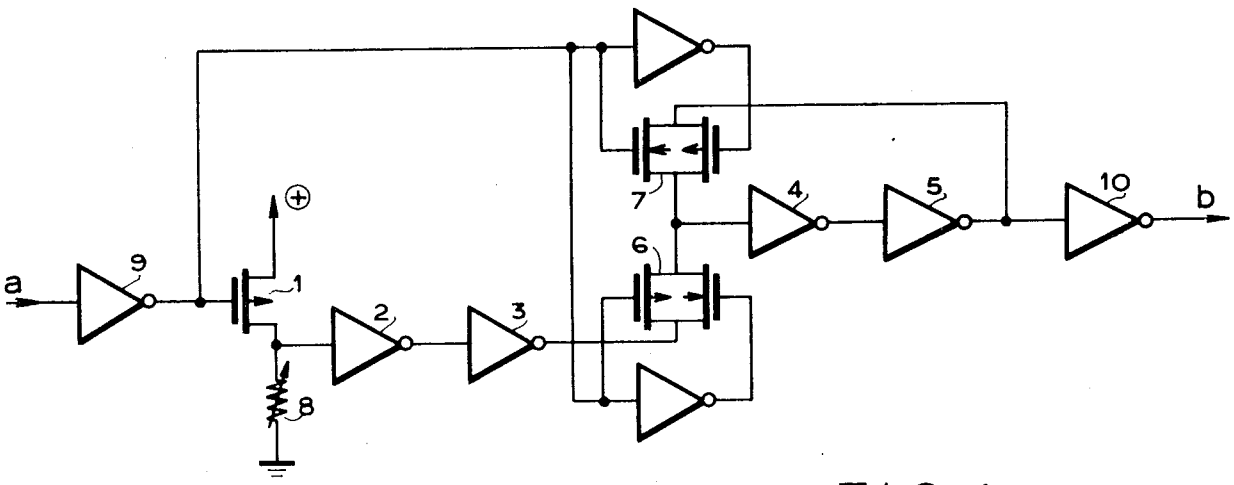
FIG. 1 PRIOR ART
FIG. 1 is a schematic diagram of a conventional electrical circuit that may be employed to detect a battery voltage.

Referring again to FIG. 2, reference numeral 23 designates a battery for supplying an electric current to the above mentioned circuit elements. Across two terminals of the battery 23 is connected a battery voltage detection circuit 24. The battery voltage detection circuit 24 is composed of a circuit which makes use of a threshold level of the FET transistor such as one shown in FIG. 1. The battery voltage detection circuit 24 functions to check the voltage of the battery 23 when an operating signal is applied to a sampling terminal S of the battery voltage detection circuit 24 as will hereinafter be described. If the battery voltage is decreased to a value which is lower than a preset value, a warning signal having "1" level is generated at an output terminal O of the battery voltage detection circuit 24. The warning signal is delivered to the display control circuit 19. Reference numeral 25 designates an AND gate and 26 an OR gate.

In the circuit shown in FIG. 2, the crystal oscillator 11, oscillation circuit, frequency divider circuit 13, time counter circuit 14, decoder 15, display driver circuit 16, electronic optical display device 17, display change-over circuit 18, and display control circuit 19 constitute a well known digital electronic timepiece. In the normal display condition at which the correction signal control circuit 22 functions to supply a signal to its normal display terminal ND, the display control circuit 19 causes respective display portions 17*a*, 17*b* of the electronic optical display device 17 to maintain at their normal display conditions.

Under such condition, if the correction switch 21 is operated, a display change-over signal having a logical "1" level is delivered from an output terminal of the AND gate 25. This display change-over signal having the logical "1" level is supplied through the OR gate 26 to the control terminal m of the display change-over circuit 18 so as to set the control terminal M to the logical value "1", so that the first display portion 17*a* and second display portion 17*b* of the electronic optical display device display the calendar information as above described. That is, under the normal display condition, the correction switch 21 functions as a display change-over switch.

The time correcting operation will now be described. If the digit selection switch 20 is operated once, its operating signal functions to set the time correction terminal Ca. As a result, the minute counter 14*a* of the time counter circuit 14 becomes correctable so as to select any desired digit. At the same time, the display control circuit 19 causes the second display portion 17*b* displaying the minute information of the electronic optical display device 17 to effect a flickering display, thereby displaying that the correction is possible. Under such condition, if the correction switch 21 is operated, correction signals whose number corresponds to the number of operations are generated at the correction signal terminal PS of the correction signal control circuit 22, thereby correcting the minute counter 14*a* which has already been in ready for correction. This correcting operation can be monitored by the second display portion 17*b* of the electronic optical display device 17.

Similarly, every time the digit selection switch 20 is operated, its operating signal functions to set the time correction terminals Cb, Cc, Cd in succession. As a result, the hour counter 14*b*, date counter 14*c*, month counter 14*d* are set in succession to correctable condition. At the same time, if the time correction terminals Cc, Cd are in their appointed conditions, the M terminal of the display change-over circuit 18 is set through the OR gate 26 to the logical "1" level, so that both the display portions 17*a*, 17*b* of the electronic optical display device 17 display the calendar information and only those display portions of the electronic optical display device 17 which correspond to the above mentioned time correction terminals function to effect the flickering display.

Under such condition, if the correction switch 21 is operated, it is possible to correct each counter set to its correctable condition.

The operating signal of the correction switch 21 under the time correction condition does not generate the display change-over signal for the display change-over circuit 18 since the AND gate 25 is closed by the logical "O" level of the normal display terminal ND of the correction signal control circuit 22.

The appointment of each time correction terminal of the correction signal control circuit 22 is returned to the normal display terminal ND after the lapse of a given time.

The battery life warning display will now be described. The battery voltage detection circuit 24 functions to measure the voltage of the battery 23 only when the display change-over signal generated at the output terminal of the AND gate 25 by the operation of the correction switch 21 under the normal display condition is supplied to the sampling terminal S of the battery voltage detection circuit 24. If the voltage value of the battery 23 reaches to a value set for warning the battery life, a warning signal of the logical "1" is generated at the output terminal O of the battery voltage detection circuit 24. This warning signal causes the display control circuit 19 to operate such that both the display portions 17*a*, 17*b* of the electronic optical display device 17 become flickering display, thereby warning that the battery life approaches to its end.

Figure 3:
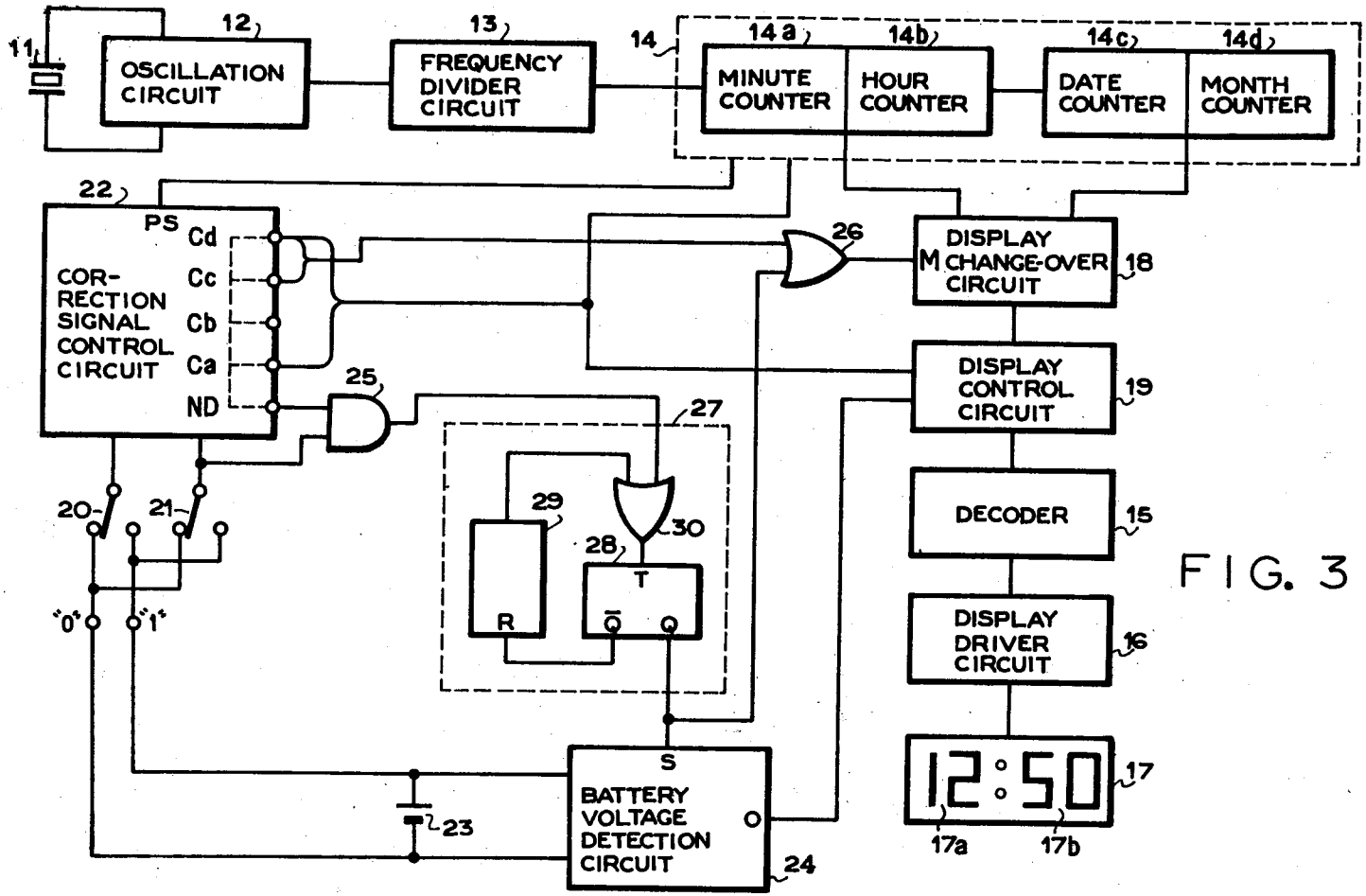
FIGS. 3 to 5 are block diagrams of modified embodiments of the timepiece shown in FIG. 2.

In FIG. 3 is shown a modified embodiment of the timepiece shown in FIG. 2. In FIG. 3, the same parts as those shown in FIG. 2 are designated by the same reference numerals. The electronic timepiece shown in FIG. 3 is a combination of the electronic timepiece shown in FIG. 2 and a display change-over return timer circuit 27. The timer circuit 27 is composed of a T type flipflop 28, a timer 29 having a reset terminal R and an OR gate 30. The flipflop 28 normally makes its output terminal Q "1" condition so as to reset the timer 29 connected to the output terminal Q.

Under such condition, if the display change-over switch 21 is operated, the signal generated at the output terminal of the AND gate 25 causes through the OR gate 30 to convert the flipflop 28. As a result, the display change-over signal having the logical "1" level is generated at the output terminal Q of the flipflop 28. This signal causes the display change-over circuit 18 to operate and hence change over the display. At the same time, the sampling terminal S of the battery voltage detection circuit 24 is set so as to determine and effect the warning display.

In addition, since the output terminal Q of the flipflop 28 is converted into the logical "0" level, the reset terminal R of the timer 29 is released to start the operation of the timer 29. When the time set to the timer 29 comes to its end, the timer 29 generates an output signal which through the OR gate 30 causes the flipflop 28 to convert again and to return to its orginal condition.

As a result, the change-over display and the battery life warn display are effected during the operation time of the timer circuit 27 and after which the timepiece is returned to its original condition.

If it is desired to forcedly return the timepiece to its original condition, the display change-over switch 21 is operated again. Then, the output signal from the AND gate 25 through the OR gate 30 causes the flipflop 28 to convert, thereby forcedly returning the flipflop 28 to its original condition.

The battery voltage detection circuit 24 may also be operated such that the output signal from the AND gate 25 generated when the display change-over switch 21 is operated is used to effect the warn display for a short time with the aid of the timer circuit 27. Alternatively, use may be made of a sampling pulse taken out of the frequency divider circuit 13 and having a short period so as to intermittently operate the timer circuit 27 and hence to reduce the consumed current required for displaying the battery life.

Figure 4:
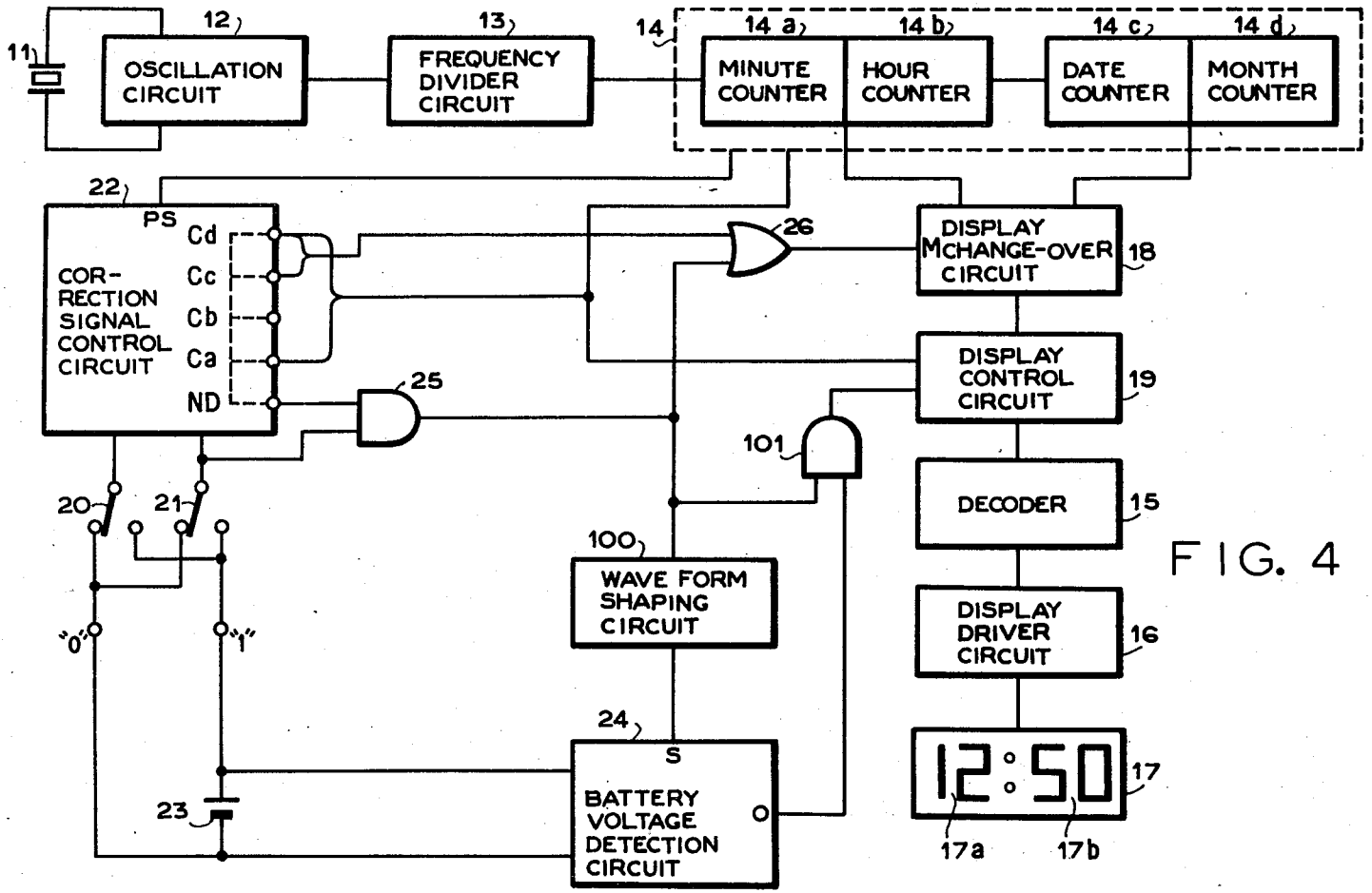

In FIG. 4 is shown another modified embodiment of the timepiece shown in FIG. 2. In the present embodiment, the electrical circuit shown in FIG. 2 further comprises a wave form shaping circuit 100 for converting the operating signal of the correction switch 21 into a pulse signal having a narrow width and an AND gate 101 for controlling the display condition of the warning signal. The signal generated at the output terminal of the AND gate 25 with the aid of the correction switch 21 is converted into a pulse signal having a narrow width by means of the wave form shaping circuit 100. This pulse signal functions to instantaneously effect sampling of the battery voltage detection circuit 24 to produce at its output terminal O a warning signal. This warning signal is delivered as an input through the AND gate 101 to the display control circuit 19 only when the correction switch 21 is made ON.

Consequently, the electronic optical display device 17 functions to effect its warning display only when the correction switch 21 is operated.

Figure 5:
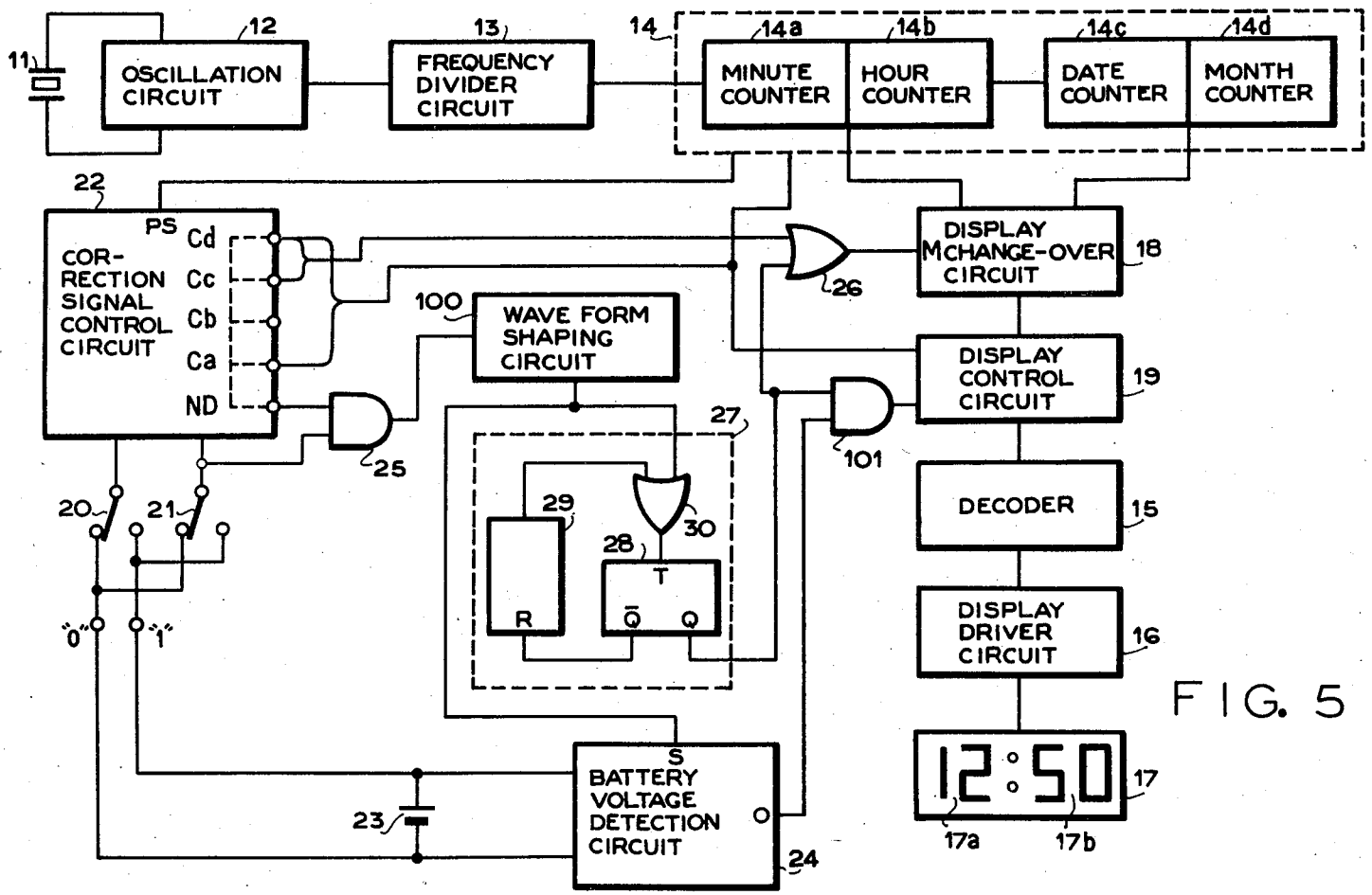

In FIG. 5 is shown a further modified embodiment of the timepiece shown in FIG. 2. In the present embodiment, the electrical circuit shown in FIG. 3 further comprises a wave form shaping circuit 100 for converting the operating signal of the correction switch 21 into a pulse signal having a narrow width and an AND gate 101 for controlling the display condition of the warning signal. This pulse signal functions to instantaneously effect sampling of the battery voltage detection circuit 24 to produce at its output terminal O a warning signal. This warning signal is delivered as an input through the AND gate 101 to the display control circuit 19 only when the timer 29 is operated.

Consequently, the electronic optical display device 17 functions to effect its warning display only when the timer 29 is operated.

In FIG. 6 is shown the correct signal control circuit 22 shown in FIGS. 2 to 5. In FIG. 6, reference numeral 50 designates a shift register for selectively appoint each correction digit and composed of five data type flipflops 51 to 55. Each data type flipflop is provided with an output terminal Q connected to a data terminal D of the next succeeding data type flipflop so as to construct a ring connection. Each data type flipflop is shifted to the next succeeding data type flipflops step by step when its clock terminal CL is supplied with an input. The output terminal Q of each data type flipflop is connected to each of the appointed terminals ND to Cd. The data type flipflops 51 to 55 are so constructed that when an input signal is supplied to a reset terminal, the data type flipflop 51 only is forcedly put into a set condition and the other data type flipflops 52 to 55 are forcedly put into a reset condition, respectively.

Reference numeral 56 designates a timer circuit for returning the position of the shift register 50 to the ND position after a given lapse of time and composed of three data type flipflops 57, 58, 59. A data terminal D of the data type flipflop 57 is normally held at the logical "1" level. As a result, if a reset terminal R of each data type flipflop is released, an input signal $\phi$ supplied to a clock terminal CL causes the data flipflops 57, 58, 59 to shift in succession. The third clock signal produces an output signal at an output terminal Q of the data flipflop 59. Reference numerals 60, 61, 62 designate wave form shaping circuits, respectively. The wave form shaping circuit 60 functions to convert the output signal from the timer circuit 56 into a pulse signal having a narrow width. The wave form shaping circuit 61 functions to convert the operating signal of the digit selection switch 20 into a pulse signal having a narrow width. The wave form shaping circuit 62 functions to convert the operating signal of the correction switch 21 into a pulse signal having a narrow width.

Reference numeral 63 designates an OR gate having three input terminals. One of these three input terminals is connected to the output terminal Q of the data type flipflop 51 and the remaining two input terminals are connected to the output terminals of the wave form shaping circuits 61, 62, respectively. An output terminal of the OR gate 63 is connected to reset terminals R of the data type flipflops 57, 58, 59 of the timer circuit 56.

The correction signal control circuit 22 constructed as above described will operate as follows. In the steady state of the shift register 50, the data type flipflop 51 only is brought into its set condition, so that the ND terminal is appointed and the electronic optical display device 17 shown in FIG. 2 is put in its normal display condition for displaying the time information.

Under such condition, the output terminal Q of the data type flipflop 51 is held at the logical "1", and as a result, the timer circuit 56 is held at its reset condition through the OR gate 63 and hence becomes inoperative under a stable condition.

Under such condition, if the digit selection switch 20 is operated one time, the operating signal is converted into a pulse signal having a narrow width by means of the wave form shaping circuit 61, thereby shifting the shift register 50 by one step. As a result, the Ca terminal of the data type flipflop 52 becomes an appointed condition, thereby rendering the minute digit correctable.

As a result, the output terminal Q of the data type flipflop 51 is converted into the logical "O" to release the reset of the timer circuit 56 through the OR gate 63. The timer circuit 56 functions to count the clock signal $\phi$ applied to the clock terminal CL thereof and having a one minute period, thereby starting its timer operation. After a lapse of three minutes, an output signal is delivered from the data type flipflop 59 through the wave form shaping circuit 60 to the shift register 50 so as to set the data type flipflop 51 and reset the data type flipflops 52 to 55, respectively, thus returning the shift register 50 to its original ND position.

If the digit selection switch 20 is operated again at a time before three minutes from the Ca terminal appointed condition are not yet passed, the shift register 50 is shifted by one step to make the Cb terminal an appointed condition.

Even in this condition, the operation of the digit selection switch 20 causes the wave form shaping circuit 61 to generate an output signal which instantaneously reset the timer circuit 56, thus starting the timer operation again. After a lapse of three minutes, the shift register 50 is returned to its original ND position. Similarly, the timer circuit 56 is capable of returning the appointed conditions of the Cc terminal and Cd terminal to the ND position.

In the correct digit selection position Ca to Cd, if the display information is to be corrected, that is, if the correction switch 21 is operated, the correction signal delivered from the wave form shaping circuit 62 is supplied through the terminal PS and the OR gate 63 to the timer circuit 56 so as to instantaneously reset it. As a result, during the correcting operation at the correction digit selecting positions, the timer circuit 56 repeats the count and reset. In practice, after three minutes from the last operation of the digit selection switch 20 and correction switch 21, the shift register 50 is returned to its original ND position.

As stated hereinbefore, in the timepiece according to the invention the sampling operation of the battery voltage detection circuit and the warning display are interlocked with the operation of the control switch, so that it is possible to make the sampling period significantly long and to avoid troublesome warning display due to the erroneous operation.

In addition, if the sampling operation of the battery voltage detection circuit and the warning display are interlocked with the operation of the display change-over switch, a timepiece bearer can never fail to notice the warning display of the battery life effected when the display change-over switch is operated. As a result, even when the warning display is effected for a short time, the timepiece bearer can notice the warning display without fail.

What is claimed is:

1. In a timepiece provided with a display device for warning a battery life, comprising:

(a) time reference signal generation means for generating a time reference signal;

(b) time counting unit signal preparing means for preparing a time counting unit signal from the time reference signal delivered from said time reference signal generation means;

(c) time counter means for counting the time counting unit delivered from said time counting unit signal preparing means;

(d) display driving means for receiving a signal delivered from said counter means and delivering a display driving signal;

(e) liquid crystal display means for effecting a digital display of the display driving signal delivered from said display driving means; and (f) an electric supply source battery for supplying energy to said respective means, the improvement comprising:

(g) a display change-over control means connected between said time counter means and said display driving means and changing over for controlling the display;

(h) exteriorly operable switch means for controlling functions of the electronic timepiece;

(i) a battery voltage detection means provided with a sampling terminal and an output terminal and detecting a voltage level of said electric supply source battery by means of a sampling pulse supplied to said sampling terminal and generating a warning signal at said output terminal when said voltage level of said electric supply source battery becomes lower than a preset value;

(j) correction signal control means for selecting either an ordinary display mode or a display correcting mode under the control of said exteriorly operable switch means; and (k) gate means for inhibiting the operation of said battery voltage detection circuit when said correction signal control circuit is in the display correcting mode.

2. The electronic timepiece according to claim 1 further comprising a circuit for supplying an operating signal of said exteriorly operable switch means to the sampling terminal of said battery voltage detection circuit.

3. The electronic timepiece according to claim 2 wherein said gate means comprises an inhibit gate for inhibiting an operating signal which is generated by the operation of said exteriorly operable switch means and supplied to said sampling terminal of said battery voltage detection circuit, when one of the input terminals of said inhibit gate is controlled by the control signal from said correction signal control circuit.

4. The timepiece according to claim 3 wherein said gate means is an AND gate.

5. The timepiece according to claim 1, wherein said time counter means has first and second modes of time counting; wherein said display change-over control means controls the display with respect to the first and second modes and is connected to and controlled by said correction signal control means; wherein said battery voltage detection means is connected between said correction signal control means and said display driving means and controlled by said correction signal control means; said correction signal control means is connected to and controlling said time counter means and said display driving means; said switch means including first and second exteriorly operable switches controlling said correction signal control means; said first exteriorly operable switch connected to said correction signal control means having three separate and distinct functions the selection of which depends upon the status of said second exteriorly operable switch connected to said correction signal control means such that when said second switch is in a normal position and said first switch is in a normal position, then the first mode is displayed; such that when said second switch is in the normal position and said first switch is in a correction position, said display change-over control means causes the second mode to be displayed and said battery voltage detection means is activated, enabling presence of poor battery condition to be displayed as a flashing of the display of the second mode; and such that when said second switch is in a correction position, said first switch serves to advance the time display one digit at a time when cycled from the normal to the correction position.

6. The timepiece according to claim 5 and further comprising a wave form shaping circuit for converting the operating signal of said first exteriorly operable switch into a pulse and delivering an output signal for instantaneously sampling said battery voltage detection circuit.

7. The timepiece according to claim 5 and further comprising a display control circuit for causing said electronic optical display device to effect the electric battery life warning display in response to the warning signal delivered from said battery voltage detection circuit and a logical product circuit connected between said display control circuit and said battery voltage detection circuit and for multiplying together the operating signal of said first exteriorly operable switch and the warning signal delivered from said battery voltage detection circuit, whereby the warning display of said electronic optical display device is effected only when said first exteriorly operable switch is operated.

8. The timepiece according to claim 5 and further comprising a timer circuit for returning the display which has been changed over by said first exteriorly operable switch to its original condition and a logical product circuit for multiplying together the output from said timer circuit and the output from said first exteriorly operable switch so as to effect the warning display only when said timer circuit is operated.

* * * * *